US006293569B1

(12) United States Patent
Ferre

(10) Patent No.: US 6,293,569 B1
(45) Date of Patent: Sep. 25, 2001

(54) TRUNDLE FOR MAKING QUICK-ASSEMBLE MOBILE SHOPPING BAG

(75) Inventor: Francisco Javier Lazaro Ferre, Barcelone (ES)

(73) Assignee: Catherine Bertin, Barcelona (ES)

( * ) Notice: Subject to any disclaimer, the term of this patent is extended or adjusted under 35 U.S.C. 154(b) by 0 days.

(21) Appl. No.: 09/440,643

(22) Filed: Nov. 16, 1999

Related U.S. Application Data

(62) Division of application No. 09/254,665, filed as application No. PCT/ES98/00167 on Jun. 10, 1998, now abandoned.

(51) Int. Cl.[7] ..... B62B 1/00

(52) U.S. Cl. ..... 280/35; 16/38; 280/79.2; 280/DIG. 3

(58) Field of Search ..... 280/DIG. 3, 79.11, 280/79.2, 35, 651, 652, 470, 47.26, 47.34; 16/38, 43

(56) References Cited

U.S. PATENT DOCUMENTS

| | | | | |
|---|---|---|---|---|
| 1,339,851 | * | 5/1920 | Josephson | 383/121.1 |
| 1,822,893 | * | 9/1931 | Kapolkin | 280/DIG. 3 |
| 2,228,066 | * | 1/1941 | Tashbook | 280/DIG. 3 |
| 2,459,865 | * | 1/1949 | Bourne | 280/DIG. 3 |
| 2,465,847 | * | 3/1949 | Coffey | 280/DIG. 3 |
| 2,610,071 | * | 9/1952 | Davis et al. | 280/DIG. 3 |
| 2,716,558 | * | 8/1955 | Sullivan | 280/DIG. 3 |
| 2,868,557 | * | 1/1959 | Klipp et al. | 280/DIG. 3 |
| 3,197,225 | * | 7/1965 | Powell | 280/DIG. 3 |
| 3,806,146 | * | 4/1974 | Shaw | 280/DIG. 3 |
| 4,195,676 | * | 4/1980 | Walker | 190/18 A |
| 4,596,397 | * | 6/1986 | Conti | 280/DIG. 3 |

FOREIGN PATENT DOCUMENTS

| | | | | |
|---|---|---|---|---|
| 2285283 | * | 9/1974 | (FR) | 280/DIG. 3 |
| 397165 | * | 2/1966 | (SE) | 280/DIG. 3 |

* cited by examiner

*Primary Examiner*—Michael Mar
(74) *Attorney, Agent, or Firm*—James Judge

(57) ABSTRACT

A disposable mobile shopping bag that can be readily assembled, and can bear loads well is. The mobile shopping bag is composed of an ordinary shopping sack, a disposable platform insert and press-fitting wheel assemblies. When opened the sack accommodates the inserted platform on base of the sack interior. The platform has press-fitting holes in positions appropriate for holding the wheel assemblies. Press-fitting mounts project from the tops of the wheel assembly forks. To put the mobile shopping bag together, the press-fitting mounts are pressed against the exterior of the bottom of the sack over the respective holes in the platform, into which they are then inserted.

5 Claims, 6 Drawing Sheets

TRUNDLE FOR MAKING QUICK-ASSEMBLE MOBILE SHOPPING BAG

This application is a continuation-in-part of U.S. application Ser. No. 09/254,665, filed Mar. 15, 1999, now abandoned which was the National Stage of International Application No. PCT/ES98/00167, filed Jun. 10, 1998.

BACKGROUND OF THE INVENTION

1. Technical Field

The present invention relates to mobile shopping bags; in particular the invention relates to shopping bags that, distinct from bag carriers, are themselves mobile for wheeled portage of consumer purchases.

2. Description of Related Art

Consumers in shopping centers and supermarkets often find themselves with bulky. purchases such as food and cleaning items that they need to transport some considerable distance by hand, and yet are without a personal handcart. This is most likely because they either do not own or wish to own a handcart, which is rather unwieldy, or do not wish to or have forgotten to bring one along.

To address the problem of a ready means for towing shopping bags heavy with purchases, a disposable shopper's cart, for example, has long since been proposed. U.S. Pat. No. 2,868,557 to Klipp and Abramson discloses such a cart. The disposable shopper's cart is formed of a single sheet of a stiff material such as cardboard, and is assembled by first folding up longitudinal rear and flanking lateral walls, which interlock by tabs. Wheels are then secured to the cart body, either on a single axle passing along the rear inside corner, or on a pair of stub axles each locked into the respective rear corners.

Clearly, the assembled disposable shopper's cart as described in the Klipp and Abramson patent has drawbacks in how the assembled cart bears weight on the wheels. Wherein a long axle carries the wheels, the axle is liable to bend, impeding the mobility of the cart; the stub axles would bear weight better, but are liable to rotate out of true, destabilizing the cart's mobility.

Moreover, the cart as taught by Klipp and Abramson requires fastening retaining cords to the cart body in order to hold a shopping bag in the cart.

U.S. Pat. No. 3,197,225 to Powell recognizes the foregoing problems and contemplates a hand-portable, collapsible shopping cart with rigid base plates and unilateral wall plates for withstanding heavy loads. A shopping cart embodied according to the Powell disclosure is fashioned from durable materials including a fabric bag and plates of aluminum, and is clearly not designed to be disposable. Furthermore, the shopping cart as claimed and taught by Powell in the principal embodiment trundles on unilateral rolling means (ball casters) mounted on a beveled surface of the bottom plate to keep the casters out of the way when the bag is opened and set down for loading. The ball casters are fixed to the beveled surface "by riveting, bolting, welding, pin-clenching or the like." The configuration essentially has the wheels mounted at the vertex where the bottom and side plates of the cart join.

Collapsible shopping carts described by Powell thus are neither mass-producible nor disposable, and the cart must be tilted onto the rolling means before the cart is mobile.

A collapsible, wheeled base assembly to which a large bag may be attached is disclosed in U.S. Pat. No. 4,596,397 to Conti. To assemble the device for use as a mobile shopping bag, a large sack such as a garbage bag is folded into a pleat around the bottom of the opened bag for insertion into pin-and-cap fittings at the corners of the base assembly. This operation would seem awkward to accomplish, although the disclosure does mention that the bag may be cemented to the base.

As taught in the Conti patent, the pair of wheels is mounted to the base on horizontally extending axles. The base is designed with a wing conformation to strengthen its rigidity, and presumably the bag-and-base assembly trundles more stably than the cart described in the Klipp and Abramson patent. Nevertheless, not only does the mobile shopping bag assembly described by Conti seem bothersome to assemble, but it also seems that in use the pleats in the bag clenched by or cemented onto the base assembly would undergo strain that could rend the bag.

Accordingly, a mobile yet disposable shopping bag that can be readily assembled by the user or pre-assembled by the merchant is desirable. Disposability is desirable since even if consumers own portable shopping carts they often tend not to bring them on shopping trips. Shoppers tend not to anticipate every instance in which their purchases become such that they wish to have mobile bag if one is at hand.

SUMMARY OF THE INVENTION

An object of the present invention is to configure a mobile shopping bag that is made of disposable materials, that can be readily assembled, and that can bear weight well and is easily trundled when assembled.

The present invention is embodied principally by a disposable platform insert, which may be foldable, having press-fitting recesses or holes in positions appropriate for holding wheels; at least two disposable wheel assemblies comprising press-fitting mounts projecting from the tops of wheel-carrying forks; and a conventional, disposable sack that when opened accommodates the platform insert in the base of the sack.

To put the mobile shopping bag together, accordingly, the sack is opened and the platform insert is placed inside the bag on the base. The press-fitting mounts on the wheel assenblies are then pressed against the exterior of the bottom of the sack over the respective holes or recesses in the platform, into which they are then inserted.

Depending on the configuration of the platform/press-fitting mounts, and the sack material, this operation may or may not puncture the bottom of the sack. In either case, clenching the material on the base of the sack in the press fitting between the wheel mounts and the platform secures the wheel assemblies to the platform through the sack.

The platform for embodying the present invention can be shaped to conform to a variety of shopping sacks depending on the form of the base of the sack when opened. The arrises (sharp edges) on the platform are rounded to reduce the chance of the sack being torn by the platform.

Since a mobile shopping bag embodied in accordance with the present invention is disposable and can be quickly assembled, it is readily available to the consumer otherwise without means to cart bulky or numerous purchases. The mobile shopping bag is thus spares shoppers who must hand-transport their purchases home or otherwise over long distances the trouble of having manually to bear weighty and numerous bags, helping to alleviate a source of back and hand pain.

The foregoing and other objects, features, aspects and advantages of the present invention will become more apparent from the following detailed description in conjunction with the accompanying drawings.

DETAILED DESCRIPTION OF THE PREFERRED EMBODIMENTS

Figure 1:
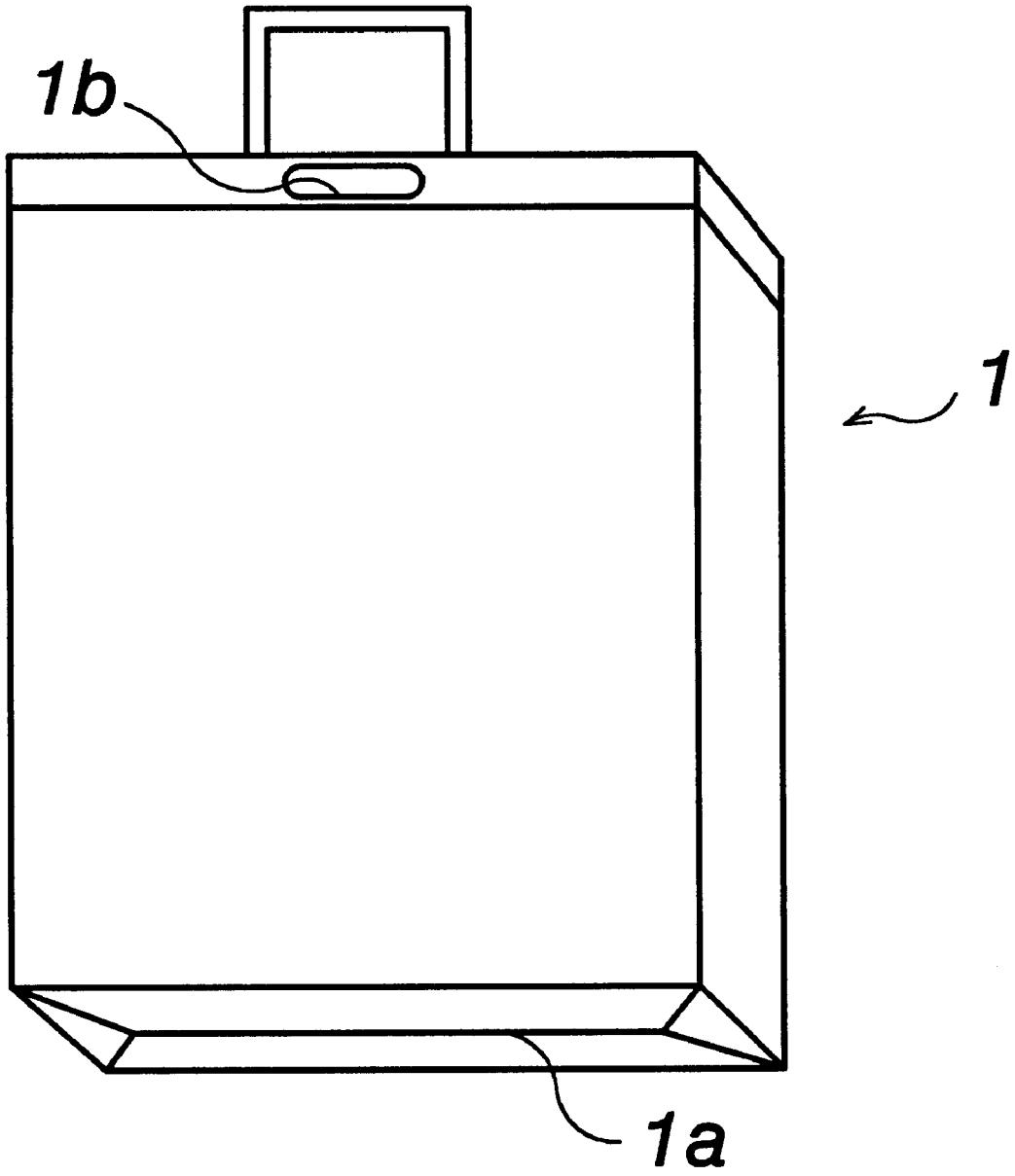
FIG. 1 is an oblique drawing representing a typical sack for holding consumer purchases.

The configuration of the present invention is such that it may, be embodied using any of a variety the sacks that typically hold shopping items. FIG. 1 depicts an example of a shopping sack 1 for embodying the invention. A bottom-end fold 1*a* is formed in the sack such that when the sack is opened it will have a base. The fold 1*a* may also be a pleat, and may be between 25–30 cm. long as a typical example.

In the present invention, nonetheless, the applicable sack need not be freestanding on the base. Accordingly, the sack suitably may be made of plastic, cloth, paper, or stiffer material such as cardboard. On the other hand, a sack with the bottom end fold 1 that holds its shape when opened facilitates introduction into the sack of a platform insert 2, described next, in putting together a mobile shopping bag embodying the invention.

A non-limiting feature of the present invention is that the upper portion of the sack composing the disposable mobile shopping bag may have openings 1*b* through which the hands can be introduced, functioning as handles. This region may include a reinforcement made as a folded part of the sack material itself, or may be of a reinforcement material. Alternatively, the sack may be made simply with handles.

Figure 2:
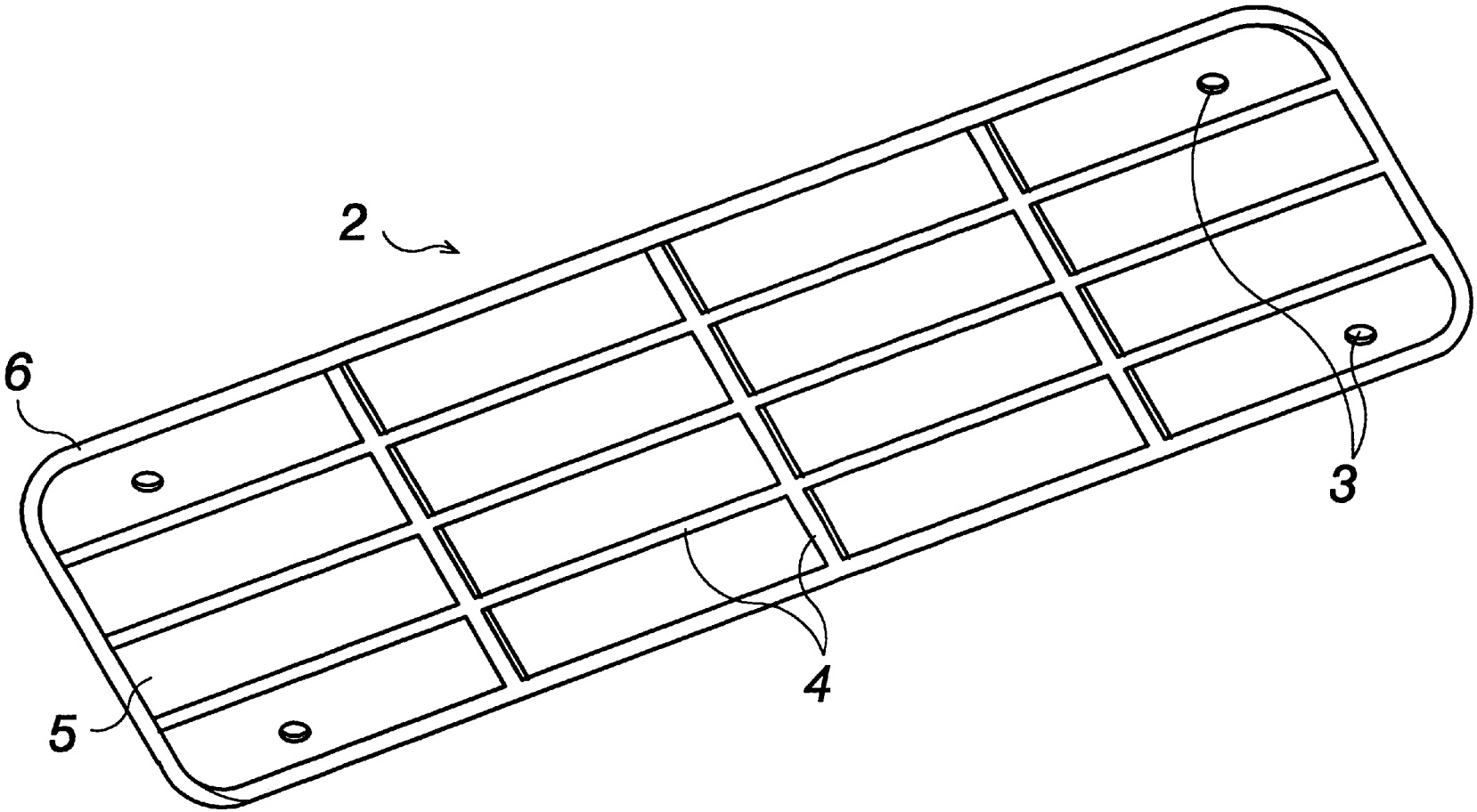
FIG. 2 is a view of the underside of a platform insert.

FIG. 2 shows a representative conformation of the platform insert 2 to which the wheels of the mobile shopping bag of the present invention are mounted. The platform insert 2 is made of a disposable material, and optionally may be foldable. Fabricating the platform insert 2 out of plastic or other synthetic resin-containing material, for example, would serve in making the platform 2 disposable as well as foldable. In the depicted embodiment, the platform 2 is about 24×40 cm.

Holes 3 in the bottom of the platform insert 2 are shaped to receive press-fitting mounts on wheel assemblies, which are described later. At least two holes 3 are provided, on the longitudinal center of the platform 2, for example. FIG. 2 depicts the platform 2 embodied with four holes near the rounded respective corners 6 of the platform 2.

The platform insert 2 optionally may be adhered or otherwise joined in advance to the interior that becomes the base of the sack when opened. In particular, when thus embodying the invention with the platform insert 2 joined in advance to the sack interior that forms the bottom of the mobile bag, if the platform 2 is foldable, the sack and platform 2 combination may be folded compactly for packaging.

Ribs 4 indicated in FIG. 2, or like reinforcements are provided crisscrossing the platform insert 2 for strengthening it in weight support. Material-saving recesses 5 assume a geometric figure, and can form the ribs. The platform 2 is thus designed according to the physical and mechanical properties of the material used, such that it may support loads of as much as 20–40 kg. or more.

Figure 3:
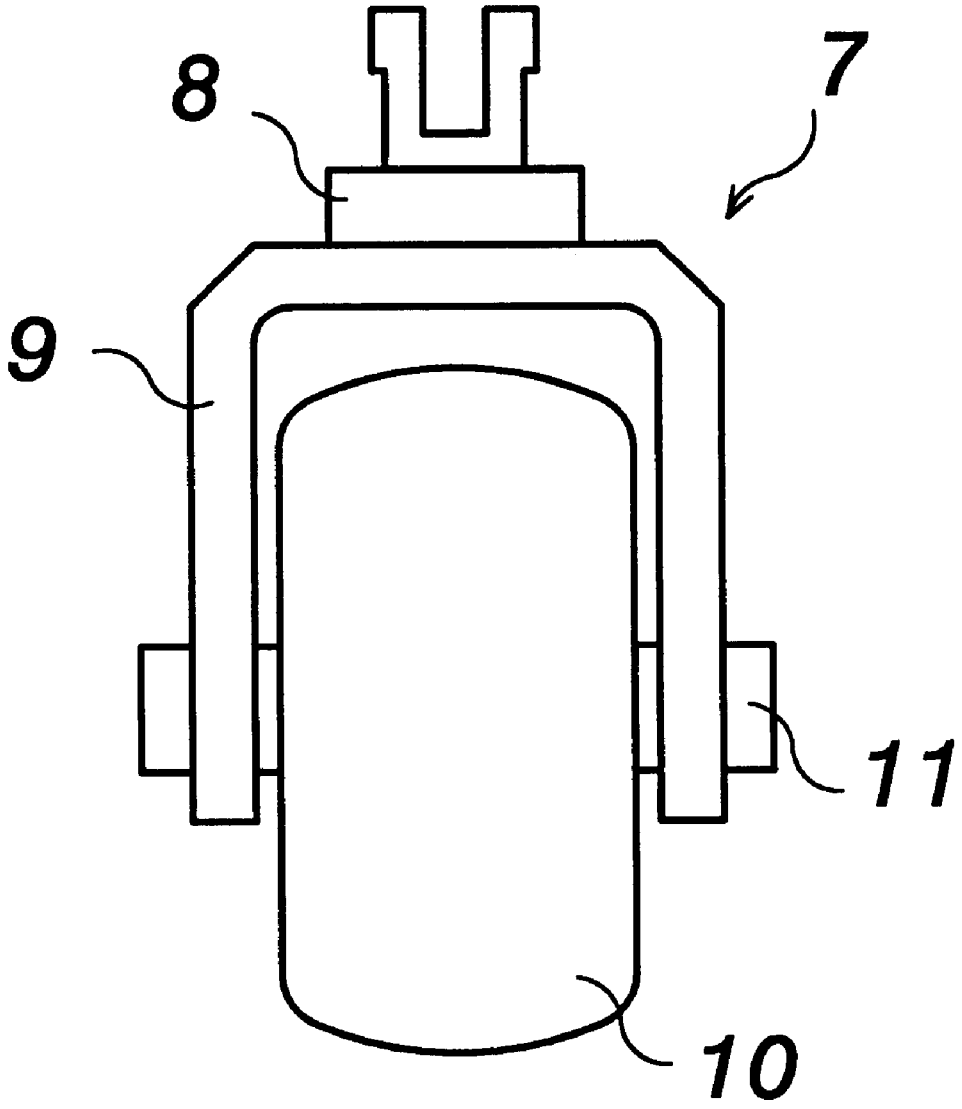
FIG. 3 is an enlarged view of a press-fitting wheel assembly.

The wheel assembly 7 depicted in FIG. 3 is composed chiefly by a press-fitting mount 8, a fork 9, and a wheel 10 on an axle 11, all of which are fabricated from disposable materials, such as those containing synthetic resins.

The axles 11 may be retained by end covers, or may be press-fitted into appropriate holes in the ends of the fork 9. Optionally, the wheel 10 and the axle 11 may be formed integrally of the same disposable material. The wheels 10 may be hollow or shaped with recesses on the faces in order to save material costs in fabrication.

Figure 4:
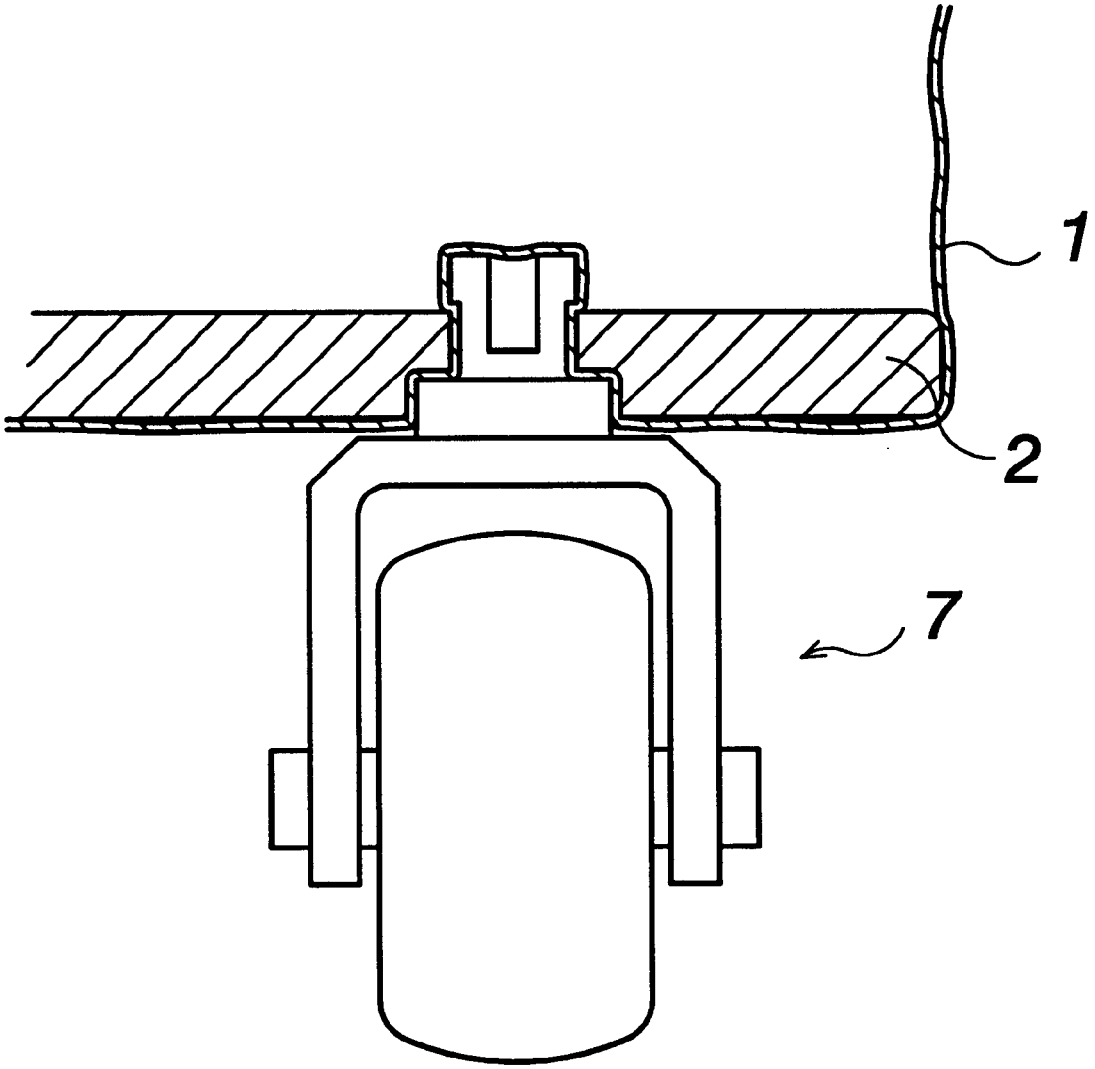
FIG. 4 depicts the wheel assembly press-fitted through a sack into a hole in a corner of the platform insert, shown in section.
Figure 5:
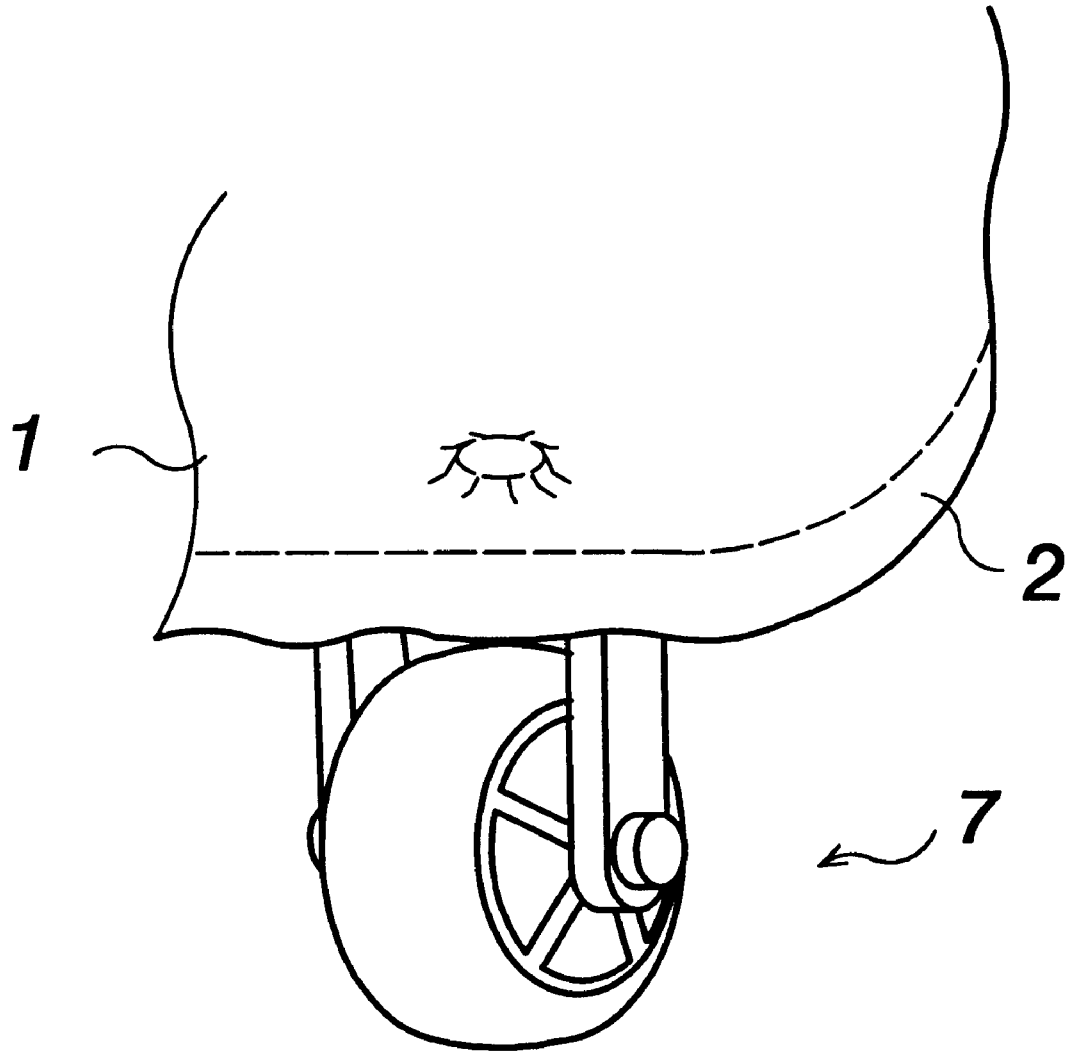
FIG. 5 is an oblique view corresponding to FIG. 4, with the platform indicated in phantom inside a fragmentary representation of the sack.

The mobile shopping bag of the present invention is realized by the platform insert 2 set onto the base of the opened sack 1 either placed there by an assembler/user or pre-adhered in manufacture. The press-fitting mount 8 is then pressed against/through the sack 1 at its bottom end, into a corresponding hole 3 in the platform 2. An assembled result is illustrated by FIG. 4. The press-fitting mounts 8 may or may not penetrate the bottom of the sack 1, (FIG. 5) but either way the sack 1 material serves to frictionally secure the mounts 8 into the sack base.

Figure 6:
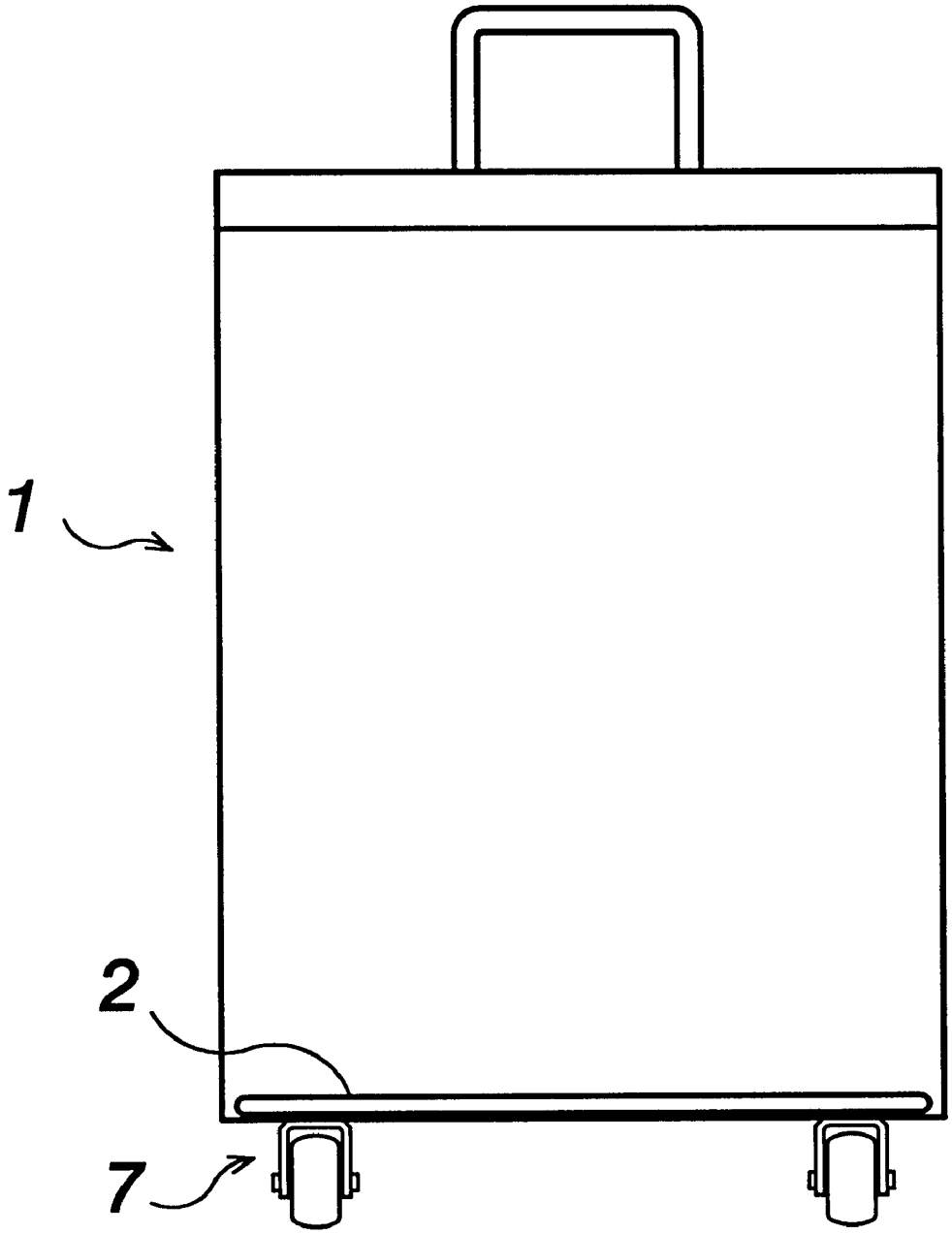
FIG. 6 is an elevational view depicting an assembled mobile shopping bag in an embodiment of the present invention.

A disposable mobile shopping bag of the present invention is accordingly quickly assembled, ready to be towed/trundled on ground surfaces, as depicted in FIG. 6. Loads in the mobile shopping bag are thus borne by the platform 2, distributed evenly through the forks 9 to the short, rigid axles 11 carrying the wheels 10.

If the platform insert 2 is foldable, it would be inserted with told-break down. The holes 3 for receiving the wheel mounts 8 can be shaped such that the mounts 8 can only be pressed into the holes 3 in one direction, as FIG. 4 shows. This ensures that the user has inserted the platform 2 in the correct orientation in the sack 1.

The snap-in/press-fitting wheel assemblies 7 can be packaged separately to be available for assembly, or may, for example, be manufactured attached to the platform insert 2 for packaging and shipping, to be broken away from the platform 2 for assembly by the user. The platform 2 may be provided separately and inserted into the sack 1 for assembly at the store, either beforehand by the store personnel, or by the shopper.

It will be understood that at minimum a pair of wheel assemblies 7 press-fitted into the holes 3 unilaterally is necessary to embody the invention properly, while a configuration using four wheel assemblies 7 is described in the foregoing. Furthermore, the holes 3 may be provided in the platform to lend the user the option of wheel assemblies 7 installed in various locations/numbers. The holes 3 in the platform for receiving the press-fitting mounts of the

What is claimed is:

1. A mobile bag assembly comprising:

a shopping sack of a disposable material having a bottom-end fold made such that when the sack is in a fully opened position, the sack is formed with a substantially planar base portion;

a platform made of a synthetic resin polymer material and formed with at least two holes extending therethrough, the platform being configured to fit within the shopping sack and overlie the base portion when placed therein while the sack is in the fully opened position; and at least two wheel assemblies, each wheel assembly including an inverted U-shaped fork member having depending leg portions for rotatably mounting a wheel therebetween and a mounting assembly formed by two members extending upwardly from a central portion of the U-shaped member, the two members having enlarged portions at upper ends thereof extending outwardly in opposed directions therefrom and the two members being flexible for permitting flexing of the two members relative to the U-shaped member, wherein the mobile bag is assembled by placing the platform within the sack and against the base portion of the sack while in the fully opened position and inserting the mounting assembly of each wheel assembly into a bottom opening of a respective hole in the platform while also pressing a portion of the sack material into the hole, the mounting assembly being inserted into the hole until the enlarged portions on the upper ends of the two members are positioned above an upper surface of the platform and outwardly of a perimeter of the hole, thereby locking the wheel assembly to the platform.

2. A mobile bag assembly as set forth in claim 1, wherein said platform is foldable.

3. A mobile bag assembly as set forth in claim 1, wherein said platform is conformed with alternating ribs and recesses for reinforcing said platform.

4. A mobile bag assembly as set forth in claim 1, wherein:

said forks of said wheel assemblies are non-rotatable with respect to said mounts; and said mounts are configured to be non-rotatable when fitted to said platform.

5. A mobile bag assembly as set forth in claim 1, wherein at least four holes are formed in said platform.

* * * * *